US006193845B1

(12) United States Patent
Graf et al.

(10) Patent No.: US 6,193,845 B1
(45) Date of Patent: Feb. 27, 2001

(54) BLOW PIPE TAIL THREADING SYSTEM FOR PAPER-MAKING MACHINES

(75) Inventors: Edwin X. Graf, Menasha; William B. Ricker, Oneida, both of WI (US)

(73) Assignee: Voith Sulzer Paper Technology North America Inc., Appleton, WI (US)

( * ) Notice: Subject to any disclaimer, the term of this patent is extended or adjusted under 35 U.S.C. 154(b) by 0 days.

(21) Appl. No.: 09/320,396

(22) Filed: May 26, 1999

(51) Int. Cl.[7] ..... D21F 1/36

(52) U.S. Cl. ..... 162/193; 162/255; 162/198; 162/263; 162/252; 226/91; 226/92; 34/114; 34/117

(58) Field of Search ..... 162/193, 255, 162/286, 194, 198, 263, DIG. 10, 252; 226/97.3, 91, 92; 34/120, 122, 114, 117; 700/127–129

(56) References Cited

U.S. PATENT DOCUMENTS

| | | | | |
|---|---|---|---|---|
| 1,369,124 | * | 2/1921 | Pope | 162/193 |
| 3,750,306 | * | 8/1973 | Rodwin et al. | 34/69 |
| 4,014,740 | * | 3/1977 | Koponen et al. | 162/289 |
| 4,726,502 | * | 2/1988 | Cryderman | 226/97 |
| 4,904,344 | * | 2/1990 | Peiffer | 162/193 |
| 4,923,567 | * | 5/1990 | Liedes et al. | 162/193 |
| 4,997,524 | * | 3/1991 | Nieminen et al. | 162/193 |
| 5,019,213 | * | 5/1991 | Virta et al. | 162/193 |
| 5,232,555 | * | 8/1993 | Daunais et al. | 162/193 |
| 5,456,802 | * | 10/1995 | Worcester | 162/289 |
| 5,503,716 | * | 4/1996 | Kivimaa et al. | 162/358.1 |
| 5,635,030 | * | 6/1997 | Meschenmoser | 162/193 |
| 5,879,515 | * | 3/1999 | Straub et al. | 162/275 |
| 5,989,393 | * | 11/1999 | Kivimaa et al. | 162/360.2 |

* cited by examiner

*Primary Examiner*—Stanley S. Silverman
*Assistant Examiner*—Jose A. Fortuna
(74) *Attorney, Agent, or Firm*—Taylor & Aust, P.C.

(57) ABSTRACT

This invention is directed to a paper-making machine utilizing rotating cylinders, especially dryer cylinders, with a drying felt intertwined about the dryer cylinders to compress the wet paper against the dryer cylinders as the wet paper travels therealong. A threading doctor assembly with a blowpipe air nozzle blowing system is associated with each dryer cylinder. When air is flowing into the blowpipe blowing system, the leading tail of the wet paper is directed from the preceding dryer cylinder to the next. A proximity sensor associated with each threading doctor assembly is in communication with a controller and is positioned to determine if the wet paper is within a detection area. Air valves or solenoids coupled between an air supply system and the blowpipes are also coupled to the controller. As the leading tail of the paper is detected by a proximity sensor to be within the detection area, the next several solenoids associated with the next several threading doctors in the paper advance direction are activated. As well, solenoids associated with the blowpipes of the threading doctors that are more than two or three behind the proximity sensor, relative to the paper advance direction are deactivated. Such sequencing of blowpipes as the leading tail advances through the system reduces the air supply pressure necessary for the system.

11 Claims, 3 Drawing Sheets

BLOW PIPE TAIL THREADING SYSTEM FOR PAPER-MAKING MACHINES

BACKGROUND OF THE INVENTION

1. Field of the Invention

The present invention relates to paper-making machines and, more particularly, to paper-making machines having air assisted threading doctor elements.

2. Description of the Related Art

Machines for making sheets of material, especially paper, utilize an array of rotating longitudinal cylinders or rolls on which the paper travels. The rolls are used in a variety of different sections during the paper making process. One of the sections is a dryer section, which may consist of several dryer sections, situated one after another. In a dryer section, as the name implies, incoming wet paper is dried by drying rolls.

In most of the various segments of the paper machine, it is known to provide a doctor element, such as a doctor blade, which bears against a roll of the section and cleans the roll by scraping off residual fibers or the like. A water shower is typically provided in association with the doctor blade for lubricating the doctor blade as it bears against the roll. The shower directs a stream of water against the roll across the width of the doctor blade and on the approach side of the doctor blade.

In sections such as a dryer section, it is known to provide a threading doctor at the beginning of a roll in order to direct the paper onto the roll. As the paper advances along the particular section, the threading doctor associated with each roll directs the paper onto the next roll. Generally, such threading doctors have air blowing systems that direct flowing air from nozzles into the region where the paper is to separate from the roll and advance to the next roll. The blowing air forces the paper to travel away from the roll and into a convergence area of the next roll for pickup by that next roll. The use of blowing air is an efficient way to direct the advancing paper since the paper generally advances at 4,000 to 6,000 feet per minute (fpm).

However, the problem with such threading systems is the enormous air pressure required to continuously supply each blowing system associated with each roll. As an example, a typical dryer group of a dryer section includes ten (10) dryer rolls each with a blowing system having an approximate twenty (20) CFM (Cubic Feet per Minute) air flow, yielding approximately two-hundred (200) SCFM. With as many as three (3) to twelve (12) dryer groups per dryer section, this may require an air supply system of six hundred (600) to two-thousand four-hundred (2,400) SCFM.

What is thus needed is an air threading system that utilizes an air supply system of considerably less SCFM.

SUMMARY OF THE INVENTION

In one form, the present invention is a paper-making machine having an air control system. The paper-making machine has a plurality of cylinders with each cylinder having an associated air blowing threading doctor assembly. The control system for the plurality of air blowing threading doctor assemblies includes an air supply system, a controller, a plurality of air valves, and a plurality of proximity sensors. The air valves are associated with each air blowing threading doctor assembly and are in communication with the controller and the air supply system. Each air valve selectively supplies air from the air supply system to the associated air blowing threading doctor assembly upon activation by the controller. Each proximity sensor is associated with each air blowing threading doctor assembly and is in communication with the controller. Each proximity sensor generates a signal upon the detection of a leading tail of the paper within a detection zone associated with each proximity sensor. The controller activates an air valve associated with an air blowing threading doctor assembly associated with a proximity sensor that generated the signal, and additionally activates a next air valve associated with a next air blowing threading doctor assembly associated with a next cylinder relative to a paper advance direction.

Additionally, in accordance with an aspect of the present invention, the air valves to previously activated threading doctors are sequentially turned off as the leading tail of the paper advances.

In another form, the present invention is a method of controlling air blowing threading doctors in a fiber material making machine having a dryer section with a plurality of dryer cylinders, an air supply system. Each of the plurality of dryer cylinders is associated with an air blowing threading doctor that is in communication with the air supply system.

The method includes supplying air from the air supply system to the air blowing threading doctor associated with a first dryer cylinder of the plurality of dryer cylinders. The presence of a leading tail of a web of fiber material being made in the fiber-making machine is detected in a detection zone, wherein a detection zone is defined as between a dryer cylinder emergence area and a next dryer cylinder convergence area relative to a fiber web material advance direction. Air from the air supply system is supplied to the air blowing threading doctors associated with at least the next two dryer cylinders relative to the fiber web material advance direction and the detection zone when the leading tail is detected. The air is shut off to the air blowing threading doctors associated with the dryer cylinders at least twice preceding the detection zone when the leading tail is detected. The detecting, air supplying, and shutting off steps are then repeated until the leading tail is detected in a final dryer cylinder detection zone.

It is an advantage of the present invention that a smaller CFM capacity air supply system can be utilized for the air threading system.

The present invention has particular advantageous use in dryer sections of a paper-making machine.

BRIEF DESCRIPTION OF THE DRAWINGS

The above-mentioned and other features and advantages of this invention, and the manner of attaining them, will become more apparent and the invention will be better understood by reference to the following description of embodiment of the invention taken in conjunction with the accompanying drawings, wherein.

Corresponding reference characters indicate corresponding parts throughout the several views. The exemplification set out herein illustrate a preferred embodiment of the invention, in one form, and such exemplification is not to be construed as limiting the scope of the invention in any manner.

DETAILED DESCRIPTION OF THE INVENTION

Figure 1:
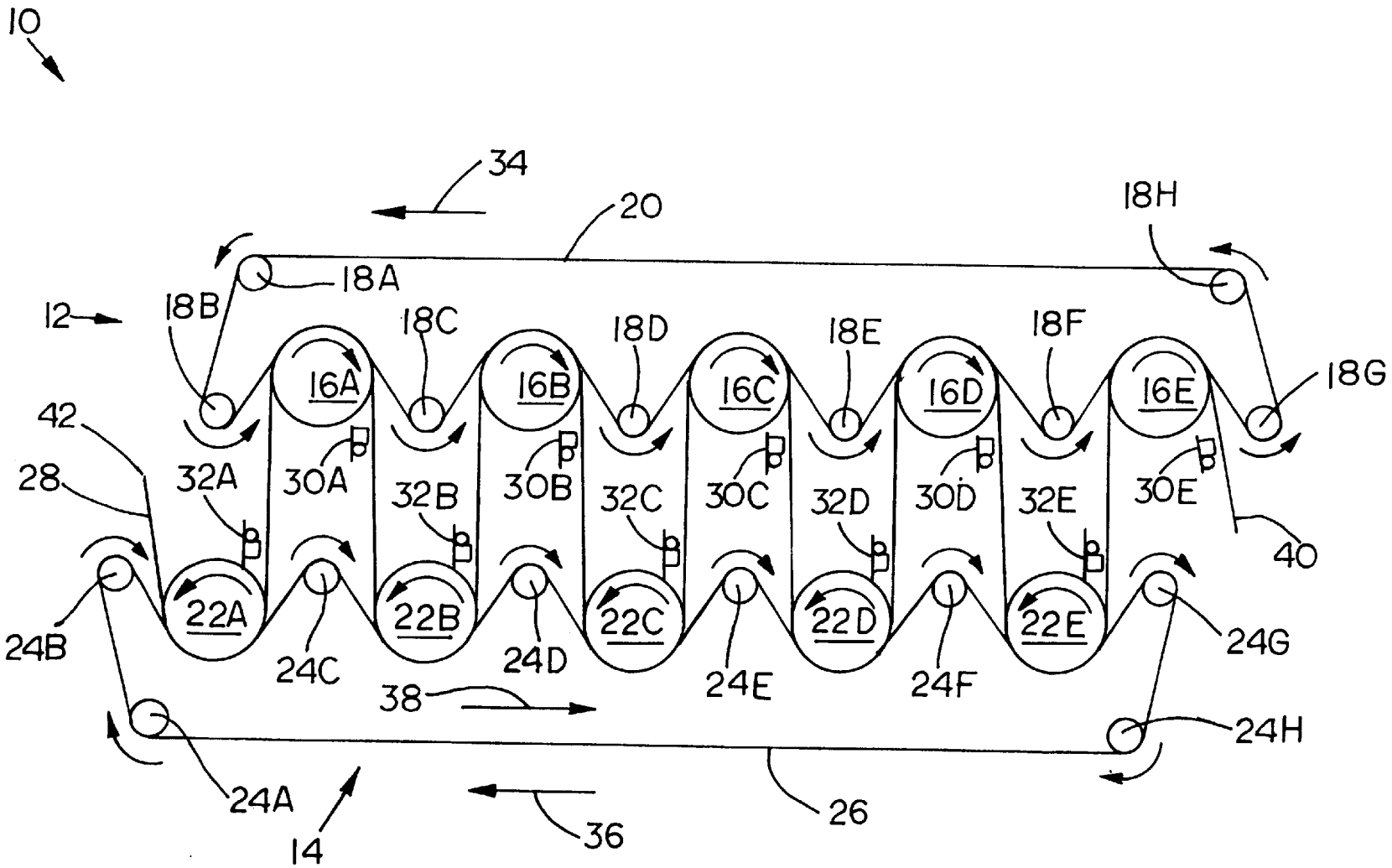
FIG. 1 is a diagrammatic side view of an embodiment of a dryer section used with a paper making process incorporating the present invention.

Referring now to the drawings and more particularly to FIG. 1, there is shown a side view of dryer group 10 forming part of a dryer section in a paper-making machine. Dryer group 10 may be one of a plurality of dryer groups which can typically number between three (3) and twelve (12) in a paper-making machine. It should be understood that dryer group 10 is representative of the plurality of such dryer groups that take the moisture out of the paper or other fiber material during the production process.

Dryer group 10 is divided into upper dryer group 12 and lower dryer group 14, which together, move paper or fiber material web 28 therethrough, here, arbitrarily from left to right as indicated by arrow 38. Upper dryer group 12 includes a plurality of upper dryer cylinders 16*a,* 16*b,* 16*c,* 16*d,* and 16*e,* each being of generally the same size and type as is typical in the art. Each upper dryer cylinder 16*a,* 16*b,* 16*c,* 16*d,* and 16*e* rotates in the direction of their respective arrow. Upper dryer group 12 also includes a plurality of upper felt guide rolls 18*a,* 18*b,* 18*c,* 18*d,* 18*e,* 18*f,* 18*g,* and 18*h* that rotatably support continuous felt sheet 20 and rotate in the direction of their respective arrow. Felt 20 travels in a continuous loop in the direction indicated by arrow 34 and is supported by upper felt guide rolls 18*b,* 18*c,* 18*d,* 18*e,* 18*f,* and 18*g* such that felt 20 contacts only the upper portion of each upper dryer cylinder 16*a,* 16*b,* 16*c,* 16*d,* and 16*e.*

Lower dryer group 14 includes a plurality of lower dryer cylinders 22*a,* 22*b,* 22*c,* 22*d,* and 22*e,* each being of generally the same size and type as is typical in the art. Each lower dryer cylinder 22*a,* 22*b,* 22*c,* 22*d,* and 22*e* rotates in the direction of their respective arrow. Lower dryer group 14 also includes a plurality of lower felt guide rolls 24*a,* 24*b,* 24*c,* 24*d,* 24*e,* 24*f,* 24*g,* and 24*h* that rotatably support continuous felt sheet 26 and rotate in the direction of their respective arrow. Felt 26 travels in a continuous loop in the direction indicated by arrow 36 and is supported by lower felt guide rolls 24*b,* 24*c,* 24*d,* 24*e,* 24*f,* and 24*g* such that felt 26 contacts only the lower portion of each lower dryer cylinder 22*a,* 22*b,* 22*c,* 22*d,* and 22*e.*

Fiber material web 28 enters dryer group 10 between lower felt guide roll 24*b* and lower dryer cylinder 22*a* between felt 26 and lower dryer cylinder 22*a* and is then intertwined in alternating lower and upper dryer cylinders, 16*a,* 22*b,* 16*b,* 22*c,* 16*c,* 22*d,* 16*d,* 22*e,* and 16*e.* In this manner, fiber material web 28 is compressed onto the surfaces of the alternating dryer cylinders by respective felts 20 or 26. In the case of the lower dryer cylinders 22*a,* 22*b,* 22*c,* 22*d,* and 22*e,* fiber web material 28 is compressed between felt 26 and the lower portion surface of the respective lower dryer cylinders. In the case of the upper dryer cylinders 16*a,* 16*b,* 16*c,* 16*d,* and 16*e,* fiber web material 28 is compressed between felt 20 and the upper portion surface of the respective upper dryer cylinders. Additionally, fiber web material 28 has a beginning and end, known in the industry as a leading tail and a trailing tail respectively. The leading tail of fiber web material 28 is designated 40, while the trailing tail of fiber web material 28 is designated 42.

Generally, the leading tail of a fiber roll is wedge-shaped as is the trailing tail. This is due to the manner in which the paper is cut. As the paper is advancing, a blade or other type of cutter is caused to move transverse to the advancing direction. The blade thus cuts a wedge shape, with the point thereof at one side where the blade starts.

Associated with each upper dryer cylinder 16*a,* 16*b,* 16*c,* 16*d,* and 16*e* is a threading doctor assembly 30*a,* 30*b,* 30*c,* 30*d,* and 30*e,* respectively, each of which is positioned on the exit side, relative to paper travel, of the respective dryer cylinder.

Associated with each lower dryer cylinder 22*a,* 22*b,* 22*c,* 22*d,* and 22*e* is a threading doctor assembly 32*a,* 32*b,* 32*c,* 32*d,* and 32*e,* respectively, each of which is positioned on the exit side, relative to fiber web travel, of the respective dryer cylinder.

Figure 2:
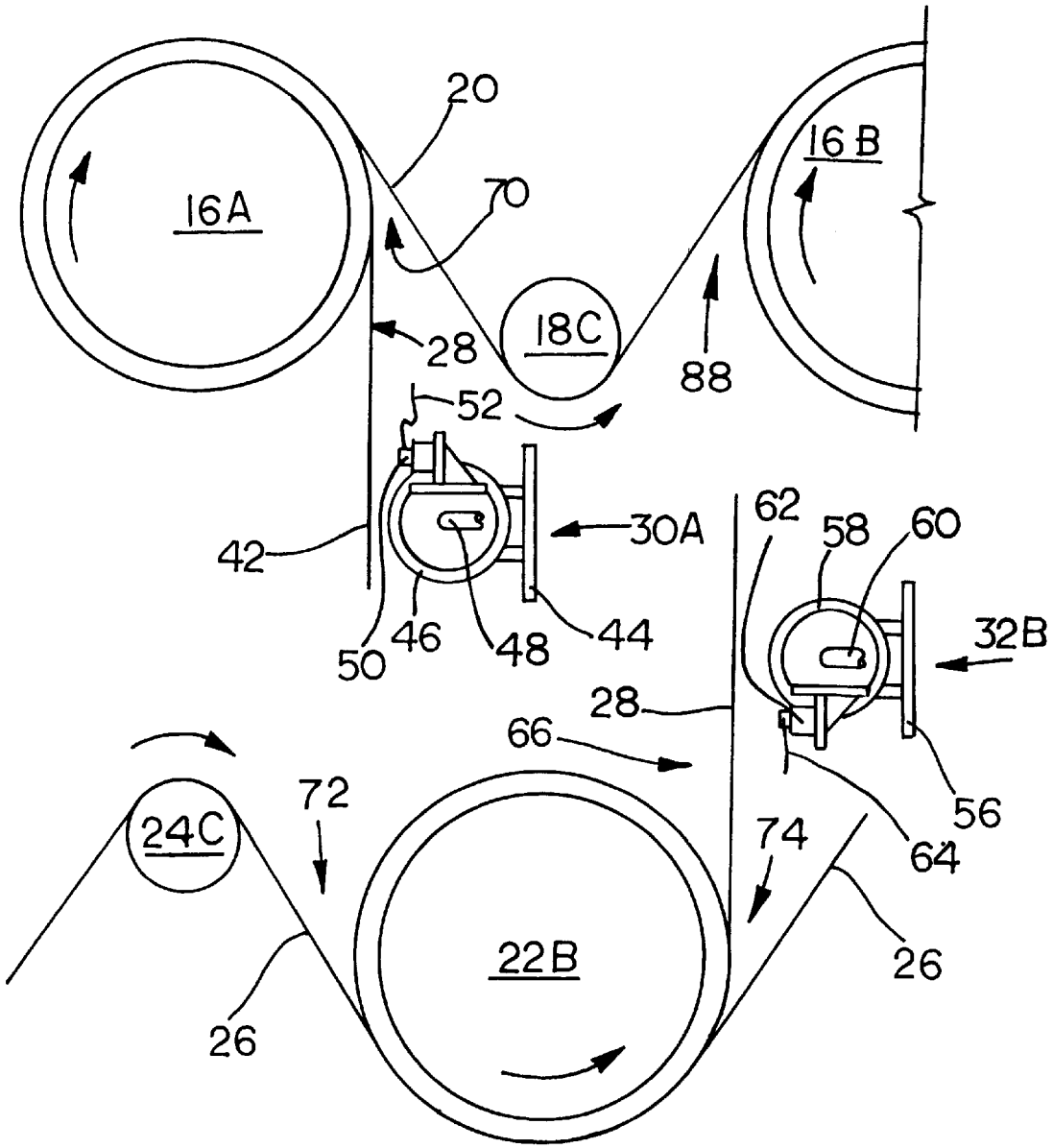
FIG. 2 is an enlarged side view of a portion of the dryer section of FIG. 1 in accordance with the present invention depicting a detecting area between dryer rolls having a paper tail therein.

With reference now to FIG. 2, there is shown an enlarged view of an area between upper dryer cylinders 16*a* and 16*b,* and lower dryer cylinder 22*b* particularly depicting threading doctor assembly 30*a,* associated with upper dryer cylinder 16*a,* and threading doctor assembly 32*b,* associated with lower dryer cylinder 22*b.*

Figure 3:
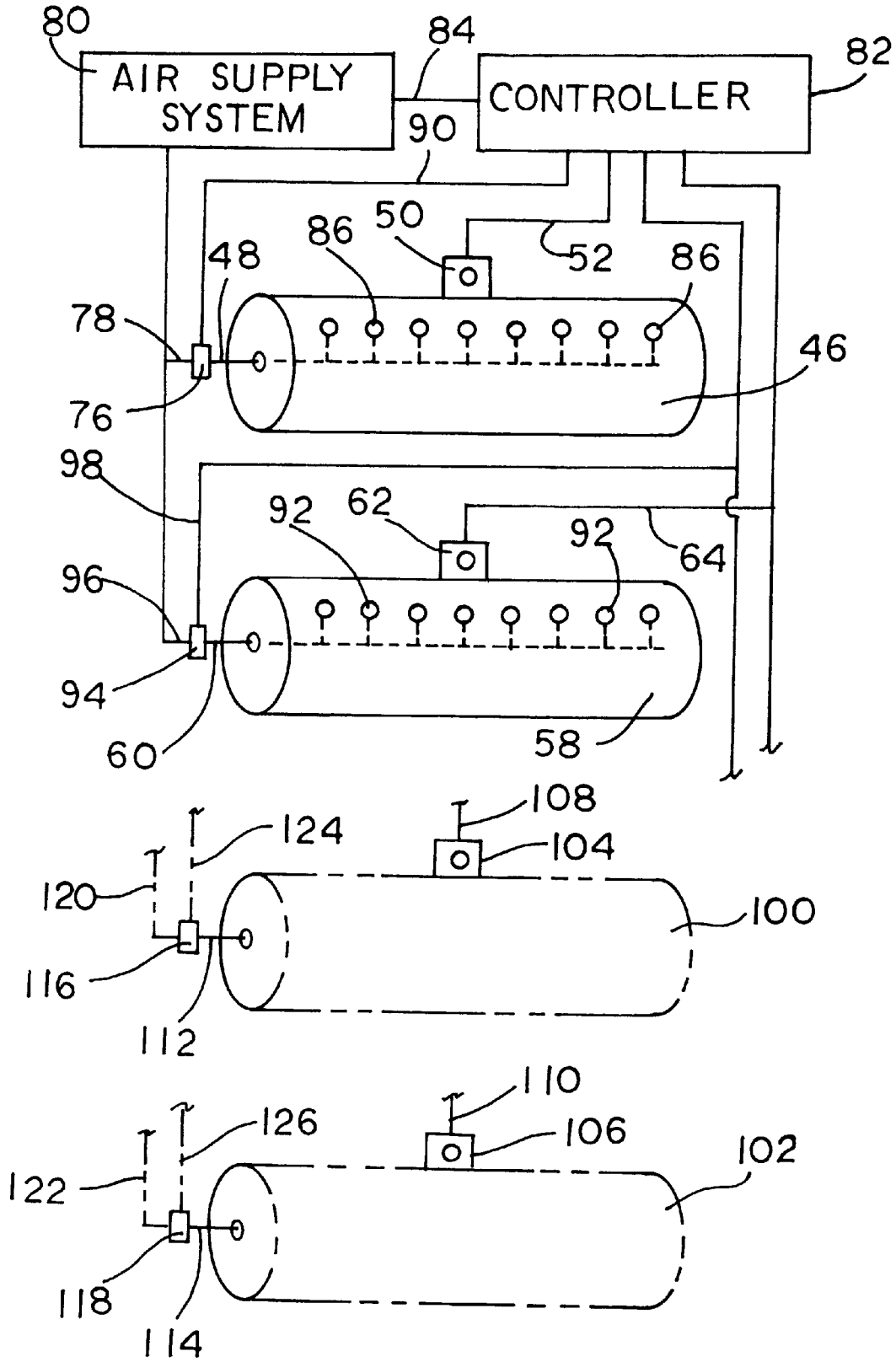
FIG. 3 is a diagrammatic view of the air supply system as coupled to the blowpipes of the threading doctors and the associated proximity sensors in communication with a controller.

Threading doctor assembly 30*a* includes doctor 44 mounted as is typical in the art adjacent the outer surface of upper dryer cylinder 16*a* on the exit side thereof, relative to fiber web material 28 travel through dryer group 10. Doctor 44 may be mounted so as to be movable toward and away from the cylinder. Doctor 44 extends a portion of the longitudinal length of upper dryer cylinder 16*a.* Mounted to doctor 44 is blowpipe 46, also extending a portion of the longitudinal length of upper dryer cylinder 16*a,* having a plurality of air nozzles 86 (see FIG. 3) therein. Blowpipe 46, and thus associated air nozzles 86, is coupled to a source of compressed or pressurized air 80 (see FIG. 3) via air conduit 48. Air is directed, forced, or blown into emergence area 70 by air nozzles 86 of blowpipe 46 where upper felt 20 disjoins from upper dryer cylinder 16*a* and fiber web material 28, compressed between upper felt 20 and the outer surface of upper dryer cylinder 16*a,* emerges. This separates the fiber web material that is compressed against upper dryer cylinder 16*a* therefrom such that the fiber web material can be directed into convergence area 72 to begin travel against lower dryer cylinder 22*b* with the aid of lower felt 26.

Mounted to blowpipe 46 is proximity sensor 50. Proximity sensor 50 may be any type of sensor, transducer, motion detector or the like that can sense or indicate whether fiber web material 28 is within sensing or detection area 54. In one form, proximity sensor 50 is an ultrasonic generator/transducer such as a SUPERPROX® proximity sensor manufactured by Hyde Park Electronics, Inc. of Dayton, Ohio. Proximity sensor 50 is adjusted such that only material within sensing or detection area 54 generates a material sensed or detected signal. With additional reference to FIG. 3, proximity sensor 50 is in communication with controller 82 via line 52. Controller 82 is in communication with air supply system 80 via line 78. Air supply system 80 is coupled via conduit 78 to air valve or solenoid 76 that is coupled to conduit 48 associated with nozzles 86 of blowpipe 46 via line 78. Controller 82 is in communication with solenoid 76 via line 90 for activation and deactivation, or on/off, control thereof. When solenoid 76 is actuated by controller 82 via line 90 in accordance with the present invention, compressed or pressurized air is caused to flow from air supply system 80 through conduit 78 and into nozzles 86 of blowpipe 46. Of course, when solenoid 76 is deactivated or turned off, the air flow into blowpipe 46 is ceased.

Threading doctor assembly 32*b* includes doctor 56 mounted as is typical in the art adjacent the outer surface of lower dryer cylinder 22*b* on the exit side thereof, relative to fiber web material 28 travel through dryer group 10. Doctor 56 may be mounted so as to be movable toward and away from the cylinder. Doctor 56 extends a portion of the longitudinal length of lower dryer cylinder 22*b*. Mounted to doctor 56 is blowpipe 58, also extending a portion of the longitudinal length of lower dryer cylinder 22*b*, having a plurality of air nozzles 92 (see FIG. 3) therein. Blowpipe 58, and thus associated air nozzles 92, is coupled to a source of compressed or pressurized air 80 (see FIG. 3) via conduit 60. Air is directed into emergence area 74 by air nozzles 92 of blowpipe 58 where lower felt 26 disjoins from lower dryer cylinder 22*b* and fiber web material 28, compressed between lower felt 26 and the outer surface of lower dryer cylinder 22*b*, emerges. This separates the fiber web material that is compressed against lower dryer cylinder 22*b* therefrom such that fiber web material 28 can be directed into convergence area 88 to begin travel against upper dryer cylinder 16*b* with the aid of upper felt 20.

Mounted to blowpipe 58 is proximity sensor 62. Proximity sensor 62 may be any type of sensor, transducer, motion detector or the like that can sense or indicate whether paper 28 is within sensing or detecting area 66. In one form, proximity sensor 62 is an ultrasonic generator/transducer such as a SUPERPROX® proximity sensor manufactured by Hyde Park Electronics, Inc. of Dayton, Ohio. Proximity sensor 62 is adjusted such that only material within sensing or detecting area 66 generates a material sensed or detected signal. With additional reference to FIG. 3, proximity sensor 50 is in communication with controller 82 via line 64. Controller 82 is in communication with air supply system 80 via line 84. Air supply system 80 is coupled via conduit 96 to air valve or solenoid 94 that is coupled to conduit 60 associated with nozzles 92 of blowpipe 58. Controller 82 is in communication with solenoid 94 via line 98 for activation and deactivation, or on/off, control thereof. When solenoid 94 is actuated by controller 82 via line 98 in accordance with the present invention, compressed or pressurized air is caused to flow from air supply system 80 through conduit 96 and into nozzles 92 of blowpipe 58. Of course, when solenoid 94 is deactivated or turned off, the air flow into blowpipe 58 is ceased.

In like manner to threading doctor assemblies 30*a* and 32*b* depicted in FIG. 2, threading doctor assemblies 30*b*, 30*c*, 30*d*, 30*e*, 32*a*, 32*c*, 32*d*, and 32*e* each include a blowpipe having air nozzles in air communication with an air valve or solenoid that is in air communication with air supply system 80, and a proximity sensor in communication with controller 82. Each solenoid is in communication with the controller 82. This is indicated by the several partial blowpipes depicted in FIG. 3 which represent a plurality of threading doctor assemblies in accordance with the present invention.

In operation, fiber web material 28 initially enters dryer group 10 and, in particular, lower dryer group 14 between lower felt 26 coming from lower felt guide roll 24*b* and lower dryer cylinder 22*a* traveling in the direction indicated by arrow 38. Fiber web material 28 is compressed against lower dryer cylinder 22*a* between lower felt 26 and the outer surface of the lower portion of lower dryer cylinder 22*a*, then exits on the opposite side of lower dryer cylinder 22*a* towards upper dryer cylinder 16*a*. At upper dryer cylinder 16*a*, fiber web material 28 becomes compressed against upper dryer cylinder 16*a* between upper felt 20 and the outer surface of the upper portion of upper dryer cylinder 16*a*. This compression scheme of the fiber web material between alternating lower and upper dryer cylinders continues until the fiber web material exits from the last dryer cylinder, here upper dryer cylinder 16*e*. In order to direct the fiber web material into the convergence area or entry point, defined as between the particular upper or lower felt and the particular upper or lower respective dryer cylinder, pressurized air from air supply 80 is directed through the blowpipe associated with the particular dryer cylinder.

Generally, before leading tail 40 of fiber web material 28 enters the first dryer cylinder, here lower dryer cylinder 22*a*, controller 82 activates at least the threading doctor blowpipe associated with that cylinder, and preferably, the next one (1) or two (2) blowpipes in the fiber web material advancing direction. All other threading doctor blowpipes are not active since the solenoids associated therewith are off or deactivated. With reference to FIG. 2, as leading tail 40 of fiber web material 28 rolls off of upper dryer cylinder 16*a* into emergence area 70 and begins to travel downwardly, proximity sensor 50 determines that leading tail 40 has entered sensing area 54. Proximity sensor 50 then sends a signal to controller 82 via line 52. As indicated above, controller 82 has preferably already activated solenoid 76 such that air from air supply system 80 is already flowing into blowpipe 46 and thus from nozzles 86. However, in accordance with an alternative approach, the moment proximity sensor 50 detects leading tail 40 within sensing area 54, sensor 50 indicates such presence to controller 82 which signals solenoid 76, via line 90, to activate and allow air to flow into blowpipe 46.

As leading tail 40 emerges from emergence area 74 into sensing or detecting area 66, proximity sensor 62 of threading doctor 32*b* detects the presence of leading tail 40. Proximity sensor then generates and sends a detection signal via line 64 to controller 82. Upon receipt of the detection signal from proximity sensor 62, controller 82 activates the solenoids of the next two (30*b*, and 32*c*) or three (30*b*, 32*c*, and 30*c*) threading doctors in the paper advance direction. As well, controller 82 sends a signal via respective lines to deactivate the solenoids of any threading doctors which are previous or behind, relative to the fiber web material advance direction, more than two or three threading doctors before proximity sensor 62. In this manner, controller 82 sequences the activation and deactivation of threading doctors as the leading tail of the fiber web material advances.

In another form, it is possible to utilize a single proximity sensor disposed at the first or second threading doctor, or several proximity sensors disposed on the beginning several threading doctors, to detect when the leading tail of the paper enters the system. Since the rotational velocity of the dryer cylinders is generally known, the controller can be programmed or determine on the fly with the aid of one or more rotational velocity sensors, when to activate the next blowpipes of the threading doctors as the fiber web material advances, and as well determine when to deactivate any preceding blowpipes that were activated.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A fiber material making machine comprising:

a plurality of cylinders;

a plurality of air blowing threading doctors, each said air blowing threading doctor associated with a respective said cylinder; and a control system for said plurality of air blowing threading doctors, said control system comprising;

an air supply system;

a plurality of air valves, each said air valve associated with a corresponding said air blowing threading doctor and connected with said air supply system, each said air valve being configured to selectively supply air from said air supply system to said associated air blowing threading doctor;

a plurality of proximity sensors, each said proximity sensor associated with a corresponding said air blowing threading doctor and generating a signal upon detection of a leading tail of a fiber material web within a detection zone associated with each said proximity sensor; and a controller coupled with said air supply system, said plurality of air valves, and said plurality of proximity sensors, said controller selectively activating said air valves dependent upon said proximity sensor signals.

2. The fiber material making machine of claim 1, wherein said air valves comprise solenoids.

3. The fiber material making machine of claim 1, wherein said proximity sensors comprise ultrasonic transducers.

4. An apparatus for controlling the advance of a fiber material through a dryer section of a fiber material making machine, the controller apparatus comprising:

a plurality of cylinders associated with the dryer section;

a plurality of air blowing threading doctors, each said air blowing threading doctor associated with a respective said cylinder;

an air supply system;

a plurality of air valves, each said air valve associated and in air communication with a respective said air blowing threading doctor and in air communication with said air supply system, each said air valve configured to selectively supply air from said air supply system to said associated air blowing threading doctor;

a plurality of proximity sensors, each said proximity sensor associated with a respective air blowing threading doctor and providing a detection signal upon sensing a leading tail of a fiber material web within a detection area associated with each said proximity sensor; and a controller in air communication with said air supply system, in communication with said plurality of air valves and said plurality of proximity sensors, said controller selectively activating and deactivating said air valves dependent upon said proximity sensor detection signals.

5. The apparatus of claim 4, wherein said air valves comprise solenoids.

6. The apparatus of claim 4, wherein said proximity sensors comprise ultrasonic transducers.

7. In a fiber material making machine having a dryer section with a plurality of dryer cylinders, an air supply system, and each of the plurality of dryer cylinders having an air blowing threading doctor in air communication with the air supply system, a method of controlling the air blowing threading doctors comprising:

supplying air from the air supply system to the air blowing threading doctor associated with a first dryer cylinder of the plurality of dryer cylinders;

detecting the presence of a leading tail of a web of fiber material being made in the fiber making machine in a detection zone, wherein a detection zone is between a dryer cylinder emergence area and a next dryer cylinder convergence area relative to a fiber web material advance direction;

supplying air from the air supply system to the air blowing threading doctors associated with at least the next two dryer cylinders relative to the fiber web material advance direction and the detection zone when the leading tail is detected;

shutting off the air to the air blowing threading doctors associated with the dryer cylinders at least twice preceding the detection zone when the leading tail is detected; and repeating the detecting, air supplying, and shutting off steps until the leading tail is detected in a final dryer cylinder detection zone.

8. The method of claim 7, wherein the leading tail of the web of fiber material is detected by a plurality of proximity detectors.

9. The method of claim 8, wherein said proximity detectors comprise ultrasonic transducers.

10. The method of claim 7, wherein the air from the air supply system is supplied and shut off by a plurality of air valves coupled to a controller coupled to a plurality of proximity detectors.

11. The method of claim 10, wherein said plurality of air valves comprise solenoids, and said plurality of proximity detectors comprise ultrasonic transducers.

* * * * *